US006990896B2

(12) United States Patent
White et al.

(10) Patent No.: US 6,990,896 B2
(45) Date of Patent: Jan. 31, 2006

(54) ELECTRIC HIGH SPEED MOLDING PRESS

(75) Inventors: Steven M. White, Wabash, IN (US); Kyle R. Schuler, Roann, IN (US)

(73) Assignee: Wabash Metal Products, Inc., Wabash, IN (US)

( * ) Notice: Subject to any disclaimer, the term of this patent is extended or adjusted under 35 U.S.C. 154(b) by 0 days.

(21) Appl. No.: 10/270,149

(22) Filed: Oct. 15, 2002

(65) Prior Publication Data

US 2004/0069163 A1 Apr. 15, 2004

(51) Int. Cl.
*B30B 15/14* (2006.01)
*B30B 15/26* (2006.01)

(52) U.S. Cl. ..... 100/49; 100/35; 100/50; 100/51; 100/289; 425/150

(58) Field of Classification Search ..... 100/290, 100/214, 257, 43, 289, 346, 50, 51, 52, 274; 72/454, 446, 19.8, 19.9, 21.3, 21.4, 21.5, 72/20.2; 74/89.14; 425/589, 138, 150; 264/40.3, 264/40.5

See application file for complete search history.

(56) References Cited

U.S. PATENT DOCUMENTS 3,178,958 A * 4/1965 Beck ..... 74/424.83
4,622,741 A * 11/1986 Dubreuil et al. ..... 29/858
4,923,383 A 5/1990 Kurumaji et al.
4,923,386 A * 5/1990 Eshima et al. ..... 425/450.1
4,929,165 A 5/1990 Inaba et al.
4,968,239 A 11/1990 Inaba et al.
5,135,385 A 8/1992 Fukuzawa et al.
5,219,146 A * 6/1993 Thompson ..... 251/7
5,349,902 A * 9/1994 Daniel et al. ..... 100/48
5,493,959 A * 2/1996 Yagi et al. ..... 100/43
5,622,737 A 4/1997 Hehl
5,645,776 A * 7/1997 Lian ..... 264/40.5
5,845,528 A * 12/1998 Wollermann ..... 72/451
5,921,125 A * 7/1999 Inoue et al. ..... 72/20.2
6,012,322 A * 1/2000 Itakura ..... 72/450
6,012,370 A * 1/2000 Kobayashi ..... 83/543

(Continued)

FOREIGN PATENT DOCUMENTS

JP 58038697 A * 3/1983

(Continued)

OTHER PUBLICATIONS

Knights, Mikell, All-Electric Technology Branches Out, Plastics Technology Online, Feature Article, Apr. 2000 [retreived on Jun. 17, 2002]. Retrieved from the Internet <URL: http://www.plasticstechnology.com/articles/200004fa2.html>.

*Primary Examiner*—Derris H. Banks
*Assistant Examiner*—Jimmy T. Nguyen
(74) *Attorney, Agent, or Firm*—Dickstein Shapiro Morin & Oshinsky LLP

(57) ABSTRACT

An electric compression press is disclosed comprising a frame having a fixed plate and a movable plate, a first member rotationally fixed in a stationary member and having a first gear set. A second member is rotationally fixed in the stationary member and has second gear teeth and third gear teeth, the second gear teeth being engaged with the first gear set of the first member. A third member is provided having fourth gear teeth engaged with the third gear teeth of the second member. The third member moves in a linear path when the first member is rotated, and wherein the third member is attached to the movable plate for moving the movable plate toward and away from the fixed plate.

10 Claims, 4 Drawing Sheets

U.S. PATENT DOCUMENTS 6,093,361 A 7/2000 Schad
6,139,301 A * 10/2000 Elleder et al. ..... 425/28.1
6,179,607 B1 1/2001 Inaba et al.
6,237,479 B1 * 5/2001 Douba ..... 100/43
6,254,371 B1 7/2001 McNally et al.
6,254,378 B1 7/2001 Berghoff
6,293,155 B1 9/2001 Babiel

FOREIGN PATENT DOCUMENTS

JP 01011041 A * 1/1989

* cited by examiner

ELECTRIC HIGH SPEED MOLDING PRESS

BACKGROUND

In general, compression and clamping apparatuses having stationary and movable platens have been employed in compression presses and in molding machines such as injection molding machines. The compression presses and mold-clamping apparatuses of this kind are designed to use a toggle mechanism, a crank mechanism or a ball-screw/ball-nut mechanism to translate the movable platen along a frame that interconnects the stationary platen and the movable platen for various operations.

With reference to FIG. 1, a conventional press 2 has a fixed plate 3, a movable plate 4, and a hydraulic actuator (or "not shown") for moving the movable plate 4. The press 2 also has a toggle mechanism 7 having toggle points 5. The toggle mechanism 7 is used, for example, during a clamping operation for generating a clamping force. These conventional apparatuses, however, have many shortcomings. For example, hydraulic systems are noisy and expensive to operate and maintain. Toggle devices, such as the toggle mechanism 7, do not deliver consistent clamping force during the compression stroke, take too much time during the clamping process, and require additional components which leads to an increase in maintenance costs. What is needed is an electric high speed molding press having direct linear actuation.

SUMMARY

The invention provides a linear actuator assembly and a press for a variety of uses. In one aspect, the invention provides a press with a linear actuator assembly comprising a stationary member, a first member rotationally fixed in the stationary member and having a first gear set, a second member rotationally fixed in the stationary member and having second gear teeth and third gear teeth, the second gear teeth being engaged with the first gear set of the first member, and a third member having fourth gear teeth engaged with the third gear teeth of the second member, wherein the third member moves in a linear path when the first member is rotated.

In another aspect, the invention provides a press having a movable plate and a stationary plate, each of the movable and stationary plates having at least one of cooling elements and heating elements, an electric drive system, having a motor and a control panel, for applying a linear actuating force to the movable plate. The electric drive system further comprises a stationary member, a first member rotationally fixed in the stationary member and having a first gear set, a second member rotationally fixed in the stationary member and having second gear teeth and third gear teeth, the second gear teeth being engaged with the first gear set of the first member. Also provided is a third member having fourth gear teeth engaged with the third gear teeth of the second member, wherein the third member moves in a linear path when the first member is rotated.

These and other features and advantages of the invention will be more clearly understood from the following detailed description and drawings of preferred embodiments of the present invention.

DETAILED DESCRIPTION OF PREFERRED EMBODIMENTS

In the following detailed description, reference is made to various specific embodiments in which the invention may be practiced. These embodiments are described with sufficient detail to enable those skilled in the art to practice the invention, and it is to be understood that other embodiments may be employed, and that structural and procedural changes may be made without departing from the spirit or scope of the present invention.

Figure 1:
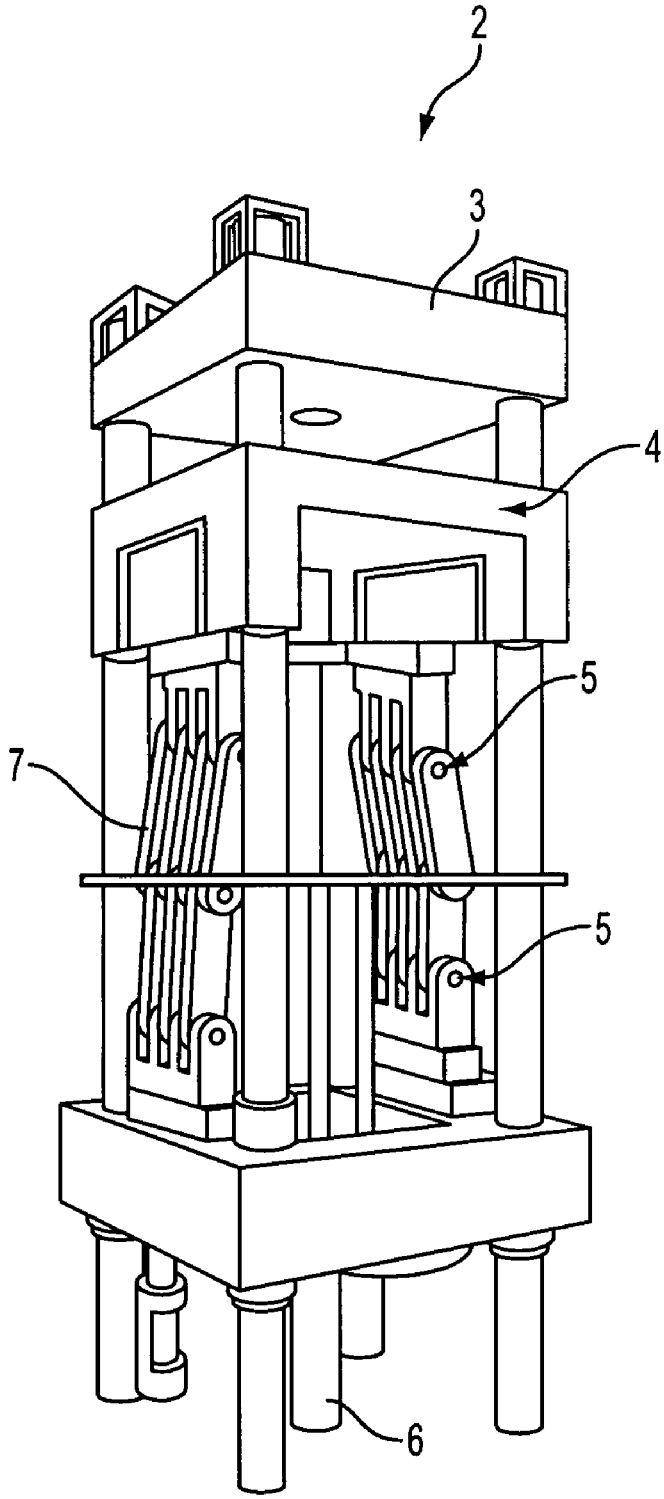
FIG. 1 (PRIOR ART)
FIG. 1 is a perspective view of a conventional press clamping mechanism.
Figure 2:
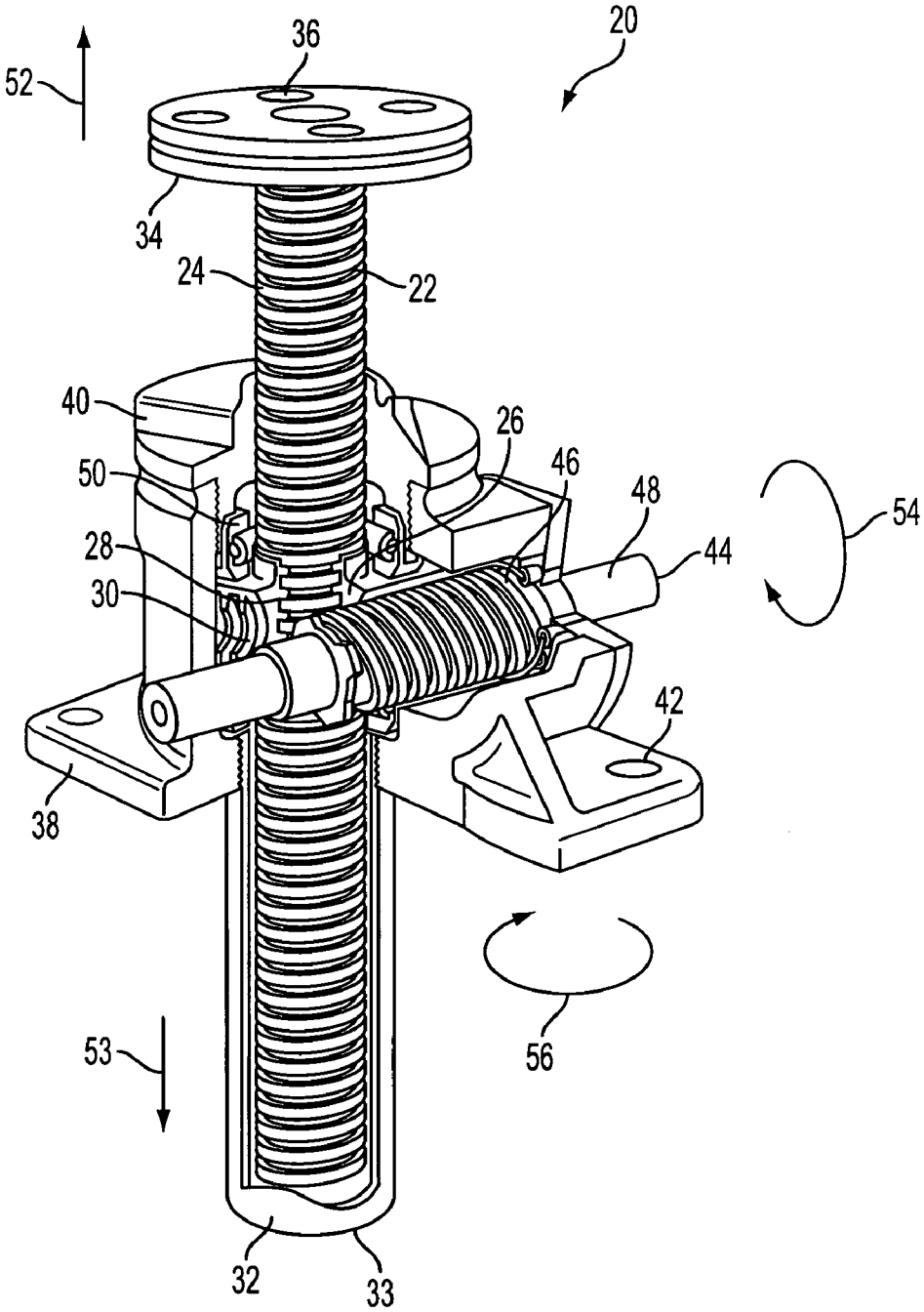
FIG. 2 is a perspective cut-away view of a linear actuator assembly in accordance with an embodiment of the present invention.

Referring now to the drawings, where like parts are designated by like reference numbers throughout, there is shown in FIG. 2 a linear actuator assembly generally designated by numeral 20. FIG. 2 shows the linear actuator assembly 20 in a partial cutaway view for ease of description. The assembly 20 comprises a linear actuator 22, a nut 26, and a transmission link 44. The linear actuator 22 has threads 24 as shown disposed along its entire length. Alternatively, a section or sections of the linear actuator 22 may be formed without threads, to save cost or for other reasons, depending upon the required length of travel of the linear actuator 22.

The nut 26 has internal threads 28 and external threads 30. The internal threads 28 of the nut 26 engage with the threads 24 of the linear actuator 22. In combination, the nut 26 with internal threads 28 and the linear actuator 22 with threads 24 function similar to a typical power screw or translation screw. Such a device is typically used to convert rotary motion, of one of the nut 26 and the linear actuator 22, to linear motion of the other one of the nut 26 and the linear actuator 22. One purpose of using a power screw is to obtain a mechanical advantage to lift weights or to exert large forces. Another purpose is to achieve precise positioning of an axial movement.

The linear actuator assembly 20 further comprises a thrust collar 50. The thrust collar 50 is positioned between a moving member (the nut 26 as will be discussed below) and a stationary member. The stationary member is an upper housing 40 which, together with a lower housing 38, comprise a fixed portion of the linear actuator assembly 20. The thrust collar 50 acts as a bearing surface between a stationary member and a moving or rotating member. Although one type of thrust collar is shown, a ball thrust collar or a simple bearing may be used.

The transmission link 44 has a shaft portion 48 and a gear portion 46. As will be discussed below, the shaft portion 48 may be connected to an external source of rotational energy. The gear portion 46, as illustrated in FIG. 2, is engaged with the external threads 30 of the nut 26. The gear portion 46 and external nut threads 30 essentially form essentially a worm gear set, which typically comprises a screw or worm (gear portion 46) meshing with a helical worm gear (threads 30 of nut 26). Rotation of the worm (gear portion 46) simulates a linearly advancing involute rack. The gear teeth of the worm gear (threads 30) are curved to partially envelop the worm.

The gear portion 46 of the transmission link 44 and the nut 26 are both rotatably fixed inside the lower housing 38 and upper housing 40. That is, rotational movement of either the transmission link 44 and the nut 26 does not result in linear movement of the components 44, 26 relative to the lower housing 38.

The linear actuator 22 is free to move linearly and rotationally with respect to the fixed lower housing 38 and upper housing 40. One portion of the linear actuator 22 (shown as the lower portion in FIG. 2) is enclosed within a protective cylinder 32. The cylinder 32 has a closed bottom end 33 which defines one limit of travel of the linear actuator 22 in the direction of arrow 53. Alternatively, the cylinder may have an open bottom to increase the range of axial travel of the linear actuator 22.

A plate 34 is affixed to an end of the linear actuator 22 (shown as the upper end in FIG. 2). The plate 34 has holes 36 which can be used to attach to the plate 34 to move together with plate 34. The lower housing 38 has holes 42 which can be used to attach the fixed portion (upper member 40 and lower member 38) of the assembly 20 to a frame of a press or the like.

Figure 3:
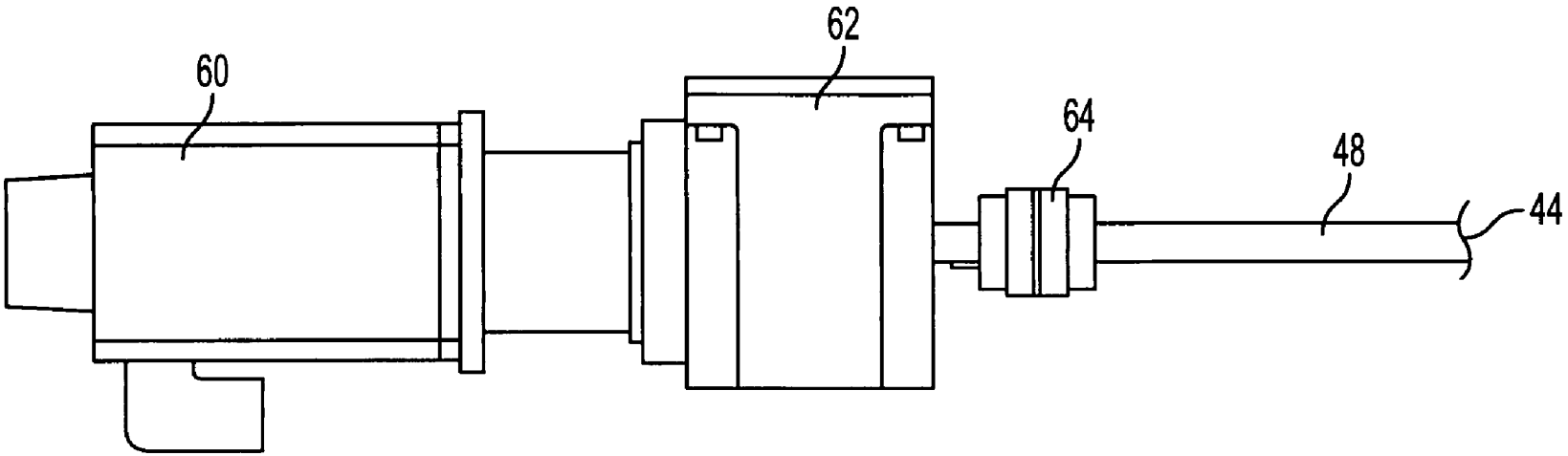
FIG. 3 is a side view of a power generation and transmission apparatus for use with the assembly of FIG. 2.

Referring now to FIG. 3, there is shown a simplified power generation and transmission apparatus for use with the linear actuator assembly 20 of FIG. 2. FIG. 3 shows an electric motor 60 connected to a reduction gear 62. The reduction gear 62, via a coupling 64, is connected to the shaft portion 48 of the transmission link 44.

In use, rotational power is supplied in a conventional manner to the transmission link 44 from the motor 60, via reduction gear 62 and coupling 64. Rotation of the transmission link 44 causes the gear portion 46 to likewise rotate. Because gear portion 46 is engaged with external threads 30 of nut 26, the nut 26 rotates. Rotation of nut 26, and thus internal threads 28 of the nut 26 which are engaged with linear actuator threads 24, causes linear motion of the linear actuator 22.

An example of a lifting motion by the linear actuator assembly 20 now will be described. With reference to FIG. 2, when the gear portion 46 or transmission link 44 is rotated (by an input from a rotation source) in a direction represented by arrow 54, the nut 26 rotates in a direction represented by arrow 56. Rotation of nut 26 in direction of arrow 56 imparts a linear motion to the linear actuator 22 in direction of arrow 52. A rotational power input to transmission link 44 and gear portion 46 in a direction opposite to arrow 54 causes the nut 26 to rotate in a direction opposite to arrow 56. Such rotation by nut 26 then causes the linear actuator 22 to travel in a direction represented by arrow 53.

Figure 4:
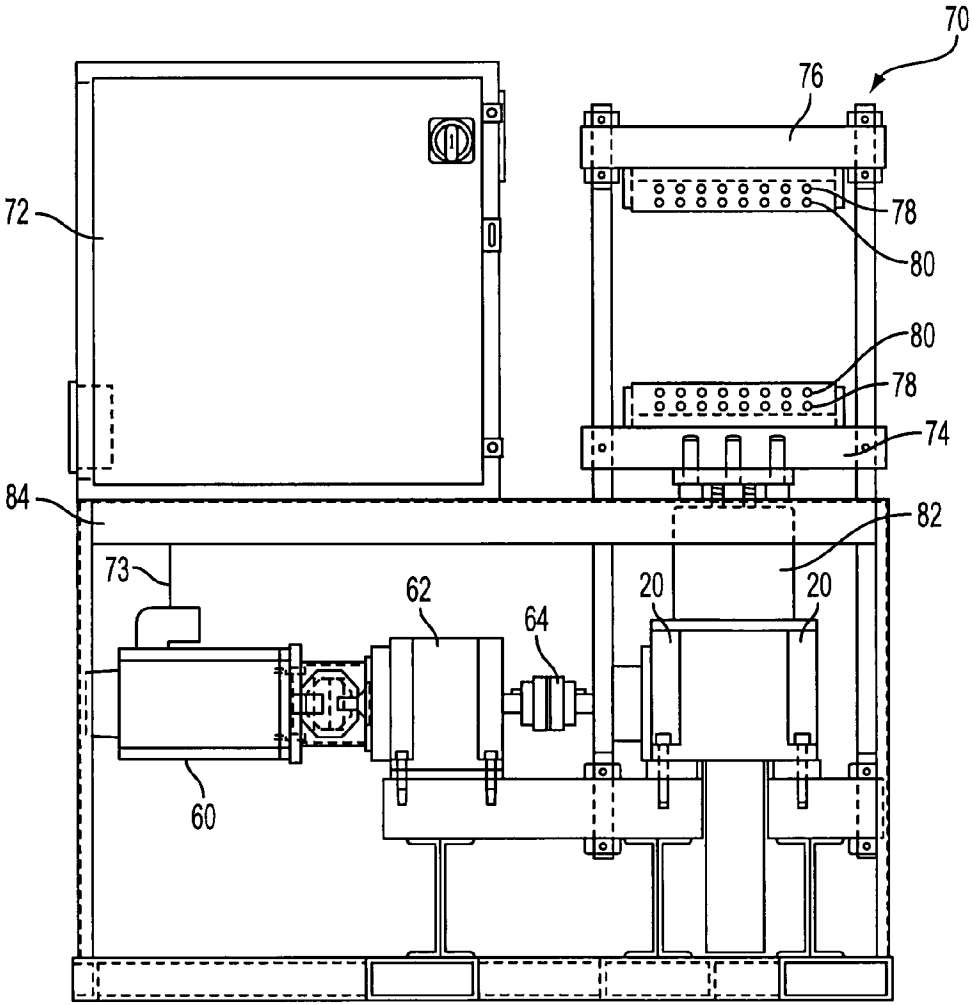
FIG. 4 is a side view of a press in accordance with an embodiment of the present invention.

FIG. 4 illustrates an electric press 70 having the linear actuator assembly of the present invention. The electric press 70 has a frame 84 and an electronic control panel 72 in addition to the motor 60, gear reducer 62 and coupling 64 previously described. The electronic control panel 72 communicates with the motor 60 via a suitable link 73, and has a controller for controlling the operational speed and force of the press as will be described below. The press 70 further comprises a movable plate 74 and a fixed plate 76. The plates 74, 76 may further comprise heating elements or conduits 78 and cooling elements or conduits 80. The heating and cooling elements 78, 80 may be used during a molding process, for example, to control the temperature of different stages of the process.

Linear actuator(s) 22 are rigidly connected via a connecting portion 82 to the moveable plate 74. Linear movement of the actuator(s) 22 causes the movable plate 74 to move toward or away from fixed plate 76. As such the press 70 is capable of functioning similar to a conventional compression press or a molding press, but with enhanced capabilities made possible by the arrangement of the invention.

The electronic control panel 72 can control the motor 60, and thus the moveable plate 74. The electronic control panel 72 can have programmable logic controllers (PLC's), computer devices, and other components, and can also incorporate artificial intelligence (AI) functions and components. The electronic control panel 72 can supply power to the motor 60, which can be a servo motor, a variable frequency motor, or another suitable motor. In use, the electronic control panel 72 can be programmed with data corresponding to specific distances the movable plate 74 has to travel, an amount of force the movable plate 74 should apply, and the duration of time to apply such force. Other functions may be incorporated into the electronic control panel 72. Benefits of this configuration include: faster response times; very quick acceleration and deceleration of travel of the movable plate 74; accurate and adjustable clamping force over the entire stroke length of the linear actuator 22; and accurate and adjustable position control over the entire stroke length of the linear actuator 22.

Thus, the disclosed press applies a linear, direct clamping force with positioning control that is more precise and consistent than in a hydraulic system. In contrast to conventional electric presses, the direct acting press eliminates the need for toggle clamping action. The press of the present invention, having a linear actuator assembly, need not incorporate a flywheel to multiply or increase applied force.

The above description and drawings are only illustrative of preferred embodiments of the present inventions, and are not intended to limit the present inventions thereto. Any subject matter or modification thereof which comes within the spirit and scope of the following claims is to be considered part of the present inventions.

What is claimed as new and desired to be protected by Letters Patent of the United States is:

1. An electric compression press comprising:

a frame having a first plate and a second plate, wherein said second plate is a movable plate;

a linear actuator connected to said second plate, a controller for controlling movement of said linear actuator to an intermediate position, which is between a first position wherein said first and second plates are in a closed position and a second position wherein said first and second plates are in an open position, wherein said intermediate position of said linear actuator corresponds to a predetermined amount of pressure between said first and second plates, and wherein said controller is programmed with data corresponding to specific distances said movable plate has to travel and an amount of force said movable plate should apply.

2. The electric compression press of claim 1, wherein said controller comprises a programmable logic controller.

3. The electric compression press of claim 1, wherein said press further comprises an AC servo motor which is controlled by said controller.

4. The electric press of claim 1, wherein said intermediate position comprises multiple intermediate positions.

5. An electric compression press comprising:

a frame having a first plate and a second plate, wherein said second plate is a movable plate;

a linear actuator connected to said second plate, a controller for controlling movement of said linear actuator between a first position wherein said first and second plates are in a closed position, and a second position wherein said first and second plates are in an open position, wherein said controller applies a predetermined amount of pressure between said first and second plates in said first position, and wherein said controller is programmed with data corresponding to specific distances said movable plate has to travel and an amount of force said movable plate should apply.

6. The electric compression press of claim 5, wherein said controller comprises a programmable logic controller.

7. The electric compression press of claim 5, wherein said press further comprises an AC servo motor which is controlled by said controller.

8. A method for using an electric compression press, the method comprising:

providing a frame having a first plate and a second plate, wherein said second plate is a movable plate;

providing a linear actuator connected to said second plate, providing a controller for controlling movement of said linear actuator;

programming said controller with data corresponding to specific distances said movable plate has to travel and an amount of force said movable plate should apply;

controlling movement of said linear actuator to an intermediate position, said intermediate position being between a first position wherein said first and second plates are in a closed position and a second position wherein said first and second plates are in an open position; and choosing a third position of said linear actuator based on a predetermined amount of pressure between said first and second plates.

9. The method according to claim 8, wherein said controlling movement of said linear actuator to an intermediate position comprises controlling movement of said linear actuator to multiple intermediate positions.

10. A method for using an electric compression press, the method comprising:

providing a frame having a first plate and a second plate, wherein said second plate is a movable plate;

providing a linear actuator connected to said second plate, providing a controller for controlling movement of said linear actuator;

programming said controller with data corresponding to specific distances said movable plate has to travel, amount of force said movable plate should apply, and duration of time to apply said force.

* * * * *